US005341934A

United States Patent [19]

Hsu

[11] Patent Number: 5,341,934

[45] Date of Patent: Aug. 30, 1994

[54] SHOCK-ABSORBING, COMPRESSION-PROTECTIVE PACKING DEVICE FOR CARTONS

[75] Inventor: Kun T. Hsu, Taipei, Taiwan

[73] Assignee: Chicony Electronics Co., Ltd., Taipei, Taiwan

[21] Appl. No.: 113,669

[22] Filed: Aug. 31, 1993

[51] Int. Cl.[5] ..... B65D 81/02

[52] U.S. Cl. ..... 206/591; 206/521

[58] Field of Search ..... 206/320, 521, 586, 587, 206/591-594

[56] References Cited

U.S. PATENT DOCUMENTS

| | | | |
|---|---|---|---|
| 2,753,101 | 7/1956 | Zimmerman | 206/320 |
| 2,835,428 | 5/1958 | Herzog | 206/594 |
| 3,184,048 | 5/1965 | Bjerum | 206/320 |
| 3,279,677 | 10/1966 | Wojcik | 206/594 |
| 3,438,482 | 4/1969 | Hamilton | 206/320 |
| 3,884,356 | 5/1975 | Lidgard | 206/594 |
| 3,980,221 | 9/1976 | Okada | 206/591 |
| 5,038,445 | 8/1991 | Jeruzal et al. | 206/586 |

FOREIGN PATENT DOCUMENTS

| | | | |
|---|---|---|---|
| 2427967 | 2/1980 | France | 206/320 |
| 4279471 | 10/1992 | Japan | 206/591 |

*Primary Examiner*—Jimmy G. Foster

*Attorney, Agent, or Firm*—Browdy and Neimark

[57] ABSTRACT

A shock absorbing packing device comprised of a product carrier and a base made by folding up respective corrugated boards into respective shapes and then connected together for holding storage items within a carton, the base having projecting strips respectively inserted into transverse grooves of the product carrier so that an open storage chamber is defined within a middle portion and two opposite side portions of the product carrier and the projecting strips of the base and supported above two longitudinal flaps of the base for keeping storage items.

2 Claims, 12 Drawing Sheets

SHOCK-ABSORBING, COMPRESSION-PROTECTIVE PACKING DEVICE FOR CARTONS

BACKGROUND OF THE INVENTION

The present invention relates to a shock-absorbing, compression-protective packing device made by folding corrugated boards into respective shapes and then connecting them together, and used for protecting storage items within a carton against impact and compression.

When packing a product with a carton, a packing or stuffing material is commonly used and inserted in the carton to protect the product against impact. Foamed plastics and paper chips are commonly used for this purpose. Paper chips can absorb shock waves, but can not protect cartons against compression. Although foamed plastics can effectively protect cartons against impact and compression, it must be properly disposed of so as not to cause environmental pollutions. However, the cost of the disposal of foamed plastics is expensive.

SUMMARY OF THE INVENTION

The present invention has been accomplished under the aforesaid circumstances. It is therefore the principal object of the present invention to provide a shock-absorbing, compression-protective packing device which can protect storage items within a carton against impact and compression.

According to the preferred embodiment of the present invention, the shock absorbing packing device comprised of a product carrier and a base made by folding up respective corrugated boards into respective shapes and then connected together for holding storage items within a carton. The base has projecting strips respectively inserted into transverse slots on the product carrier so that an open storage chamber is defined within a middle portion and two opposite side portions of the product carrier and the projecting strips of the base and supported above two longitudinal flaps of the base for keeping storage items.

DETAILED DESCRIPTION OF THE PREFERRED EMBODIMENT

Figure 1:
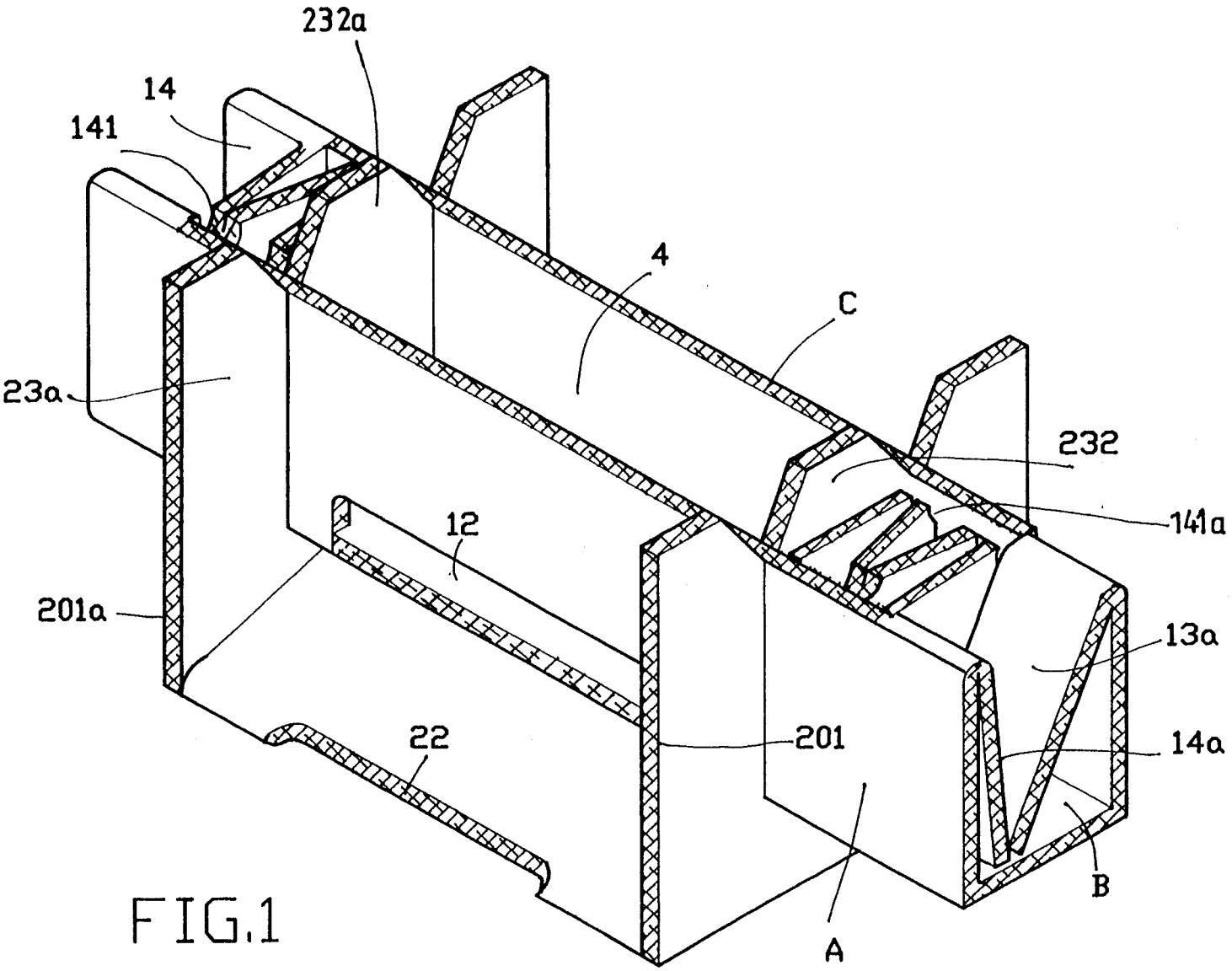
FIG. 1 is a perspective view of shock-absorbing, compression-protective packing device according to the preferred embodiment of the present invention.
Figure 2:
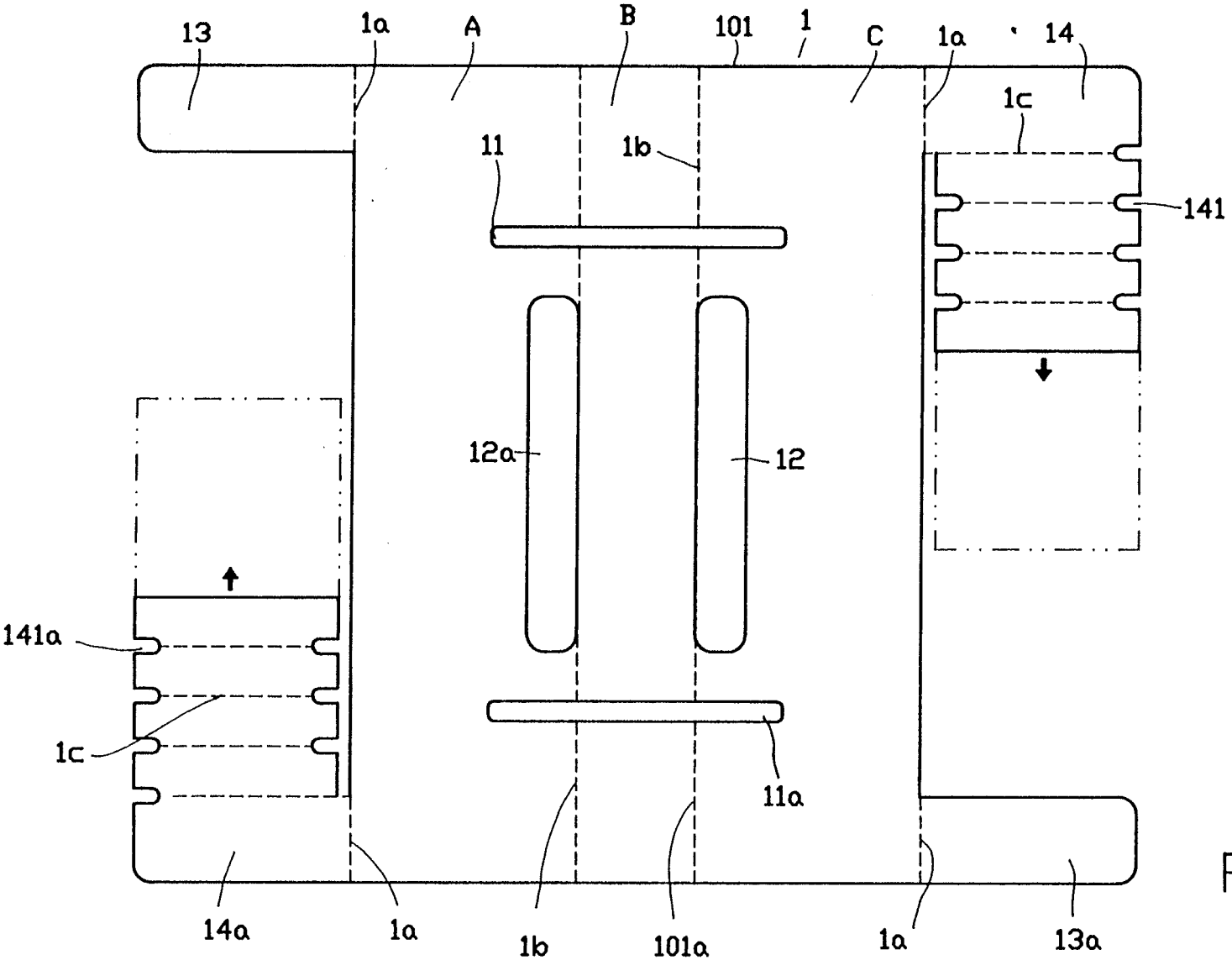
FIG. 2 is an extended out view of the product carrier of the shock-absorbing, compression-protective packing device shown in FIG. 1.
Figure 3:
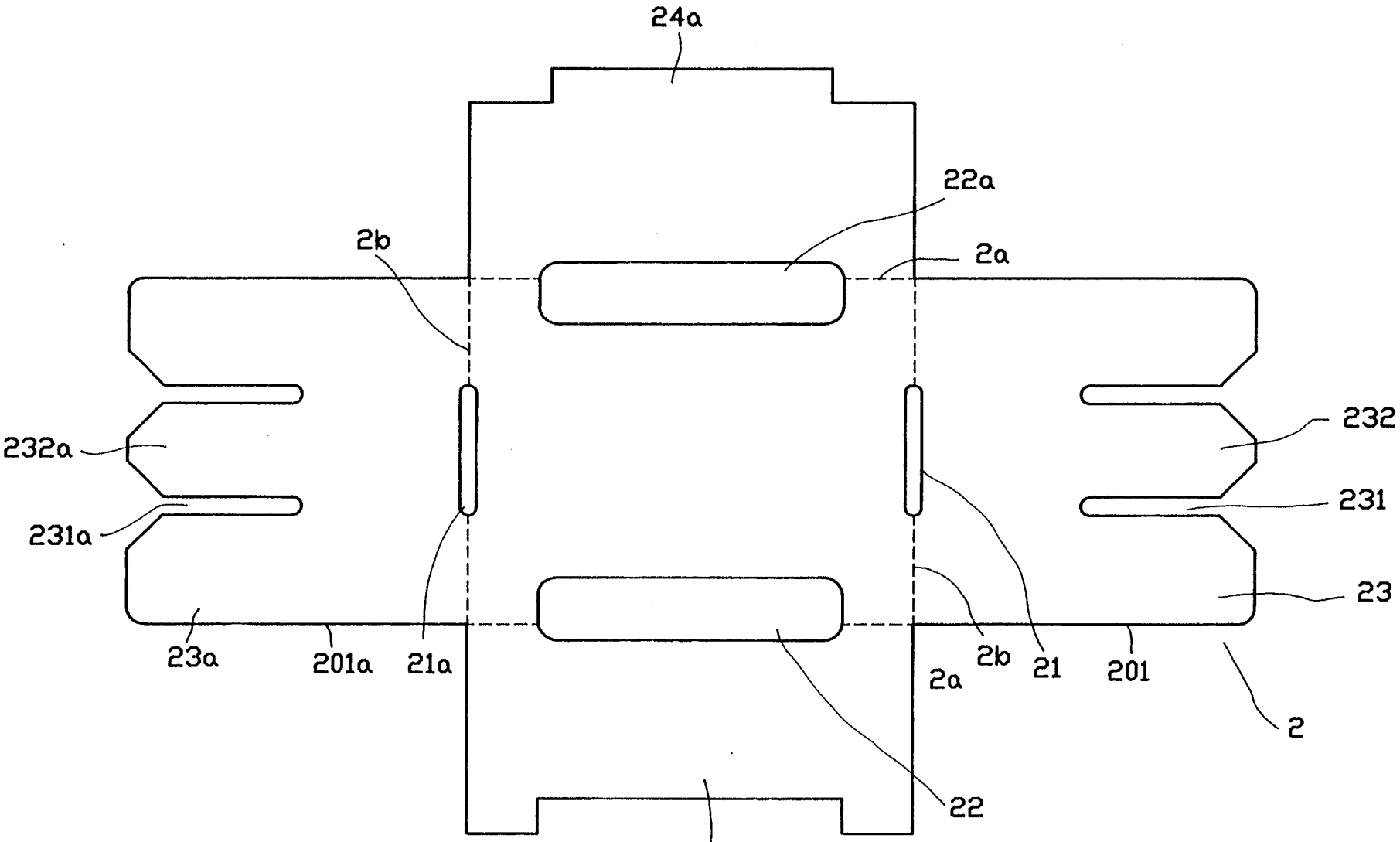
FIG. 3 is an extended out view of the base of the shock-absorbing, compression-protective packing device shown in FIG. 2.
Figure 4:
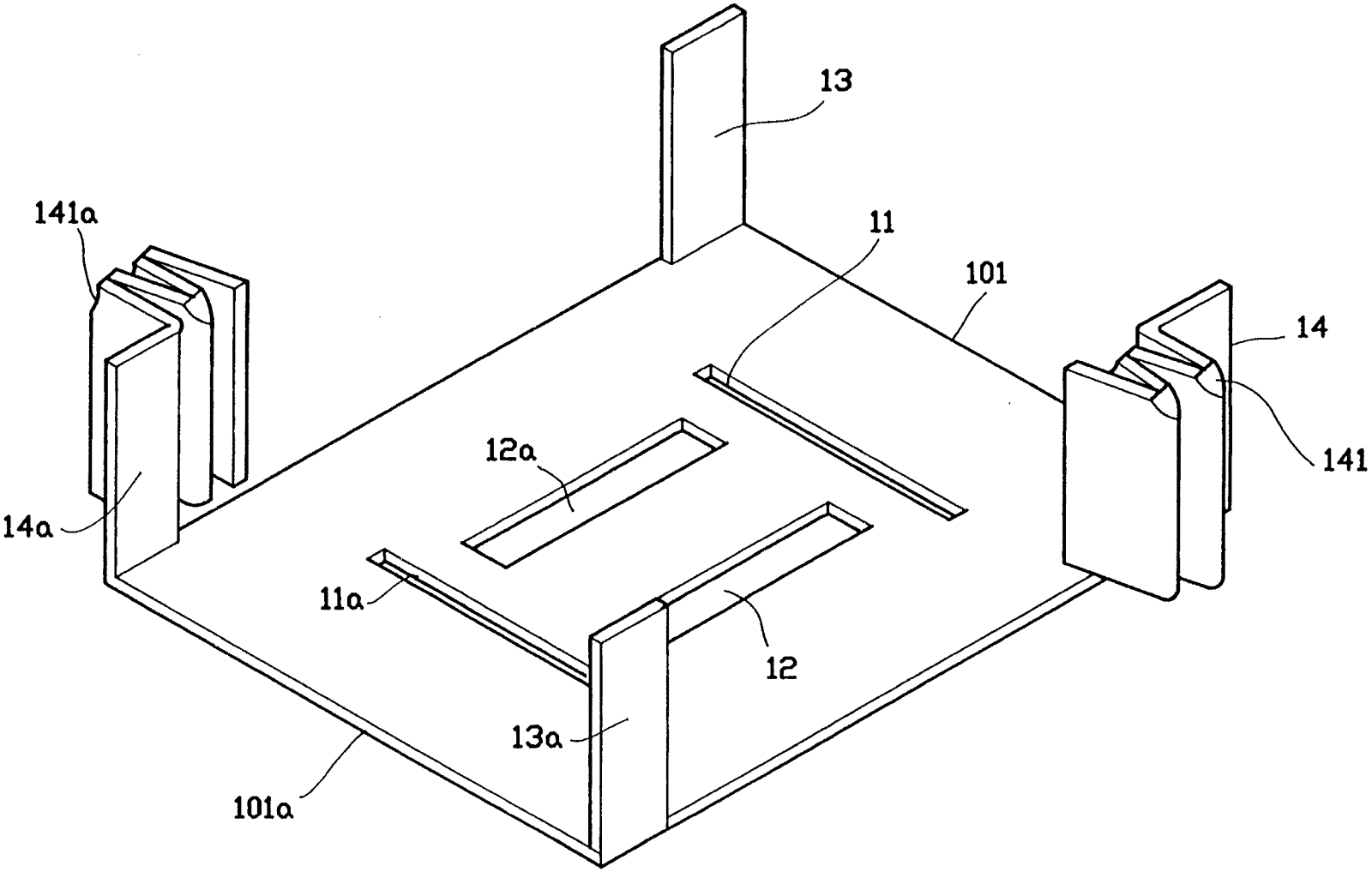
FIG. 4 illustrates the fastening strips and projecting flaps of the product carrier folded up.
Figure 5:
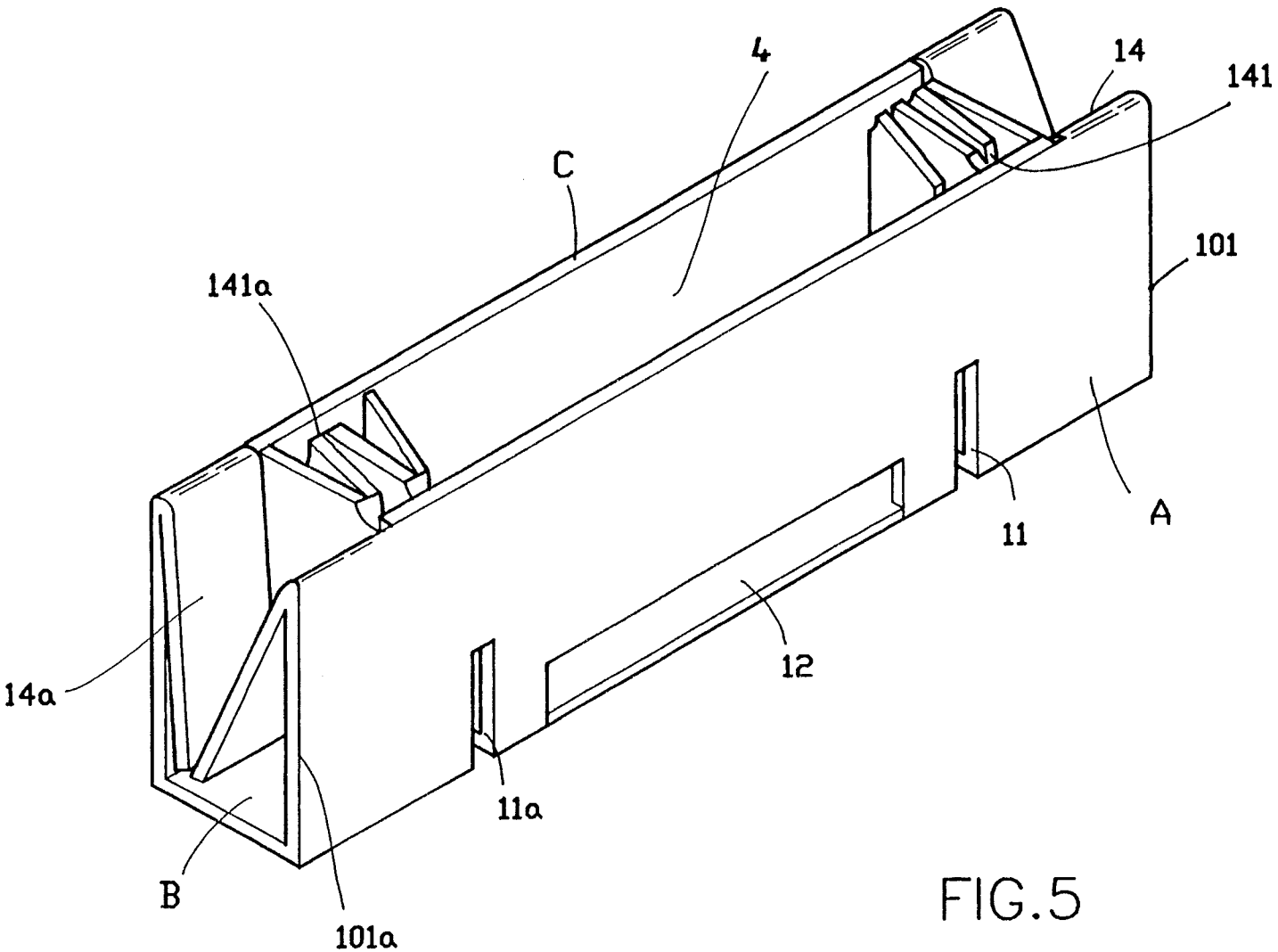
FIG. 5 shows the product carrier folded up into shape.
Figure 6:
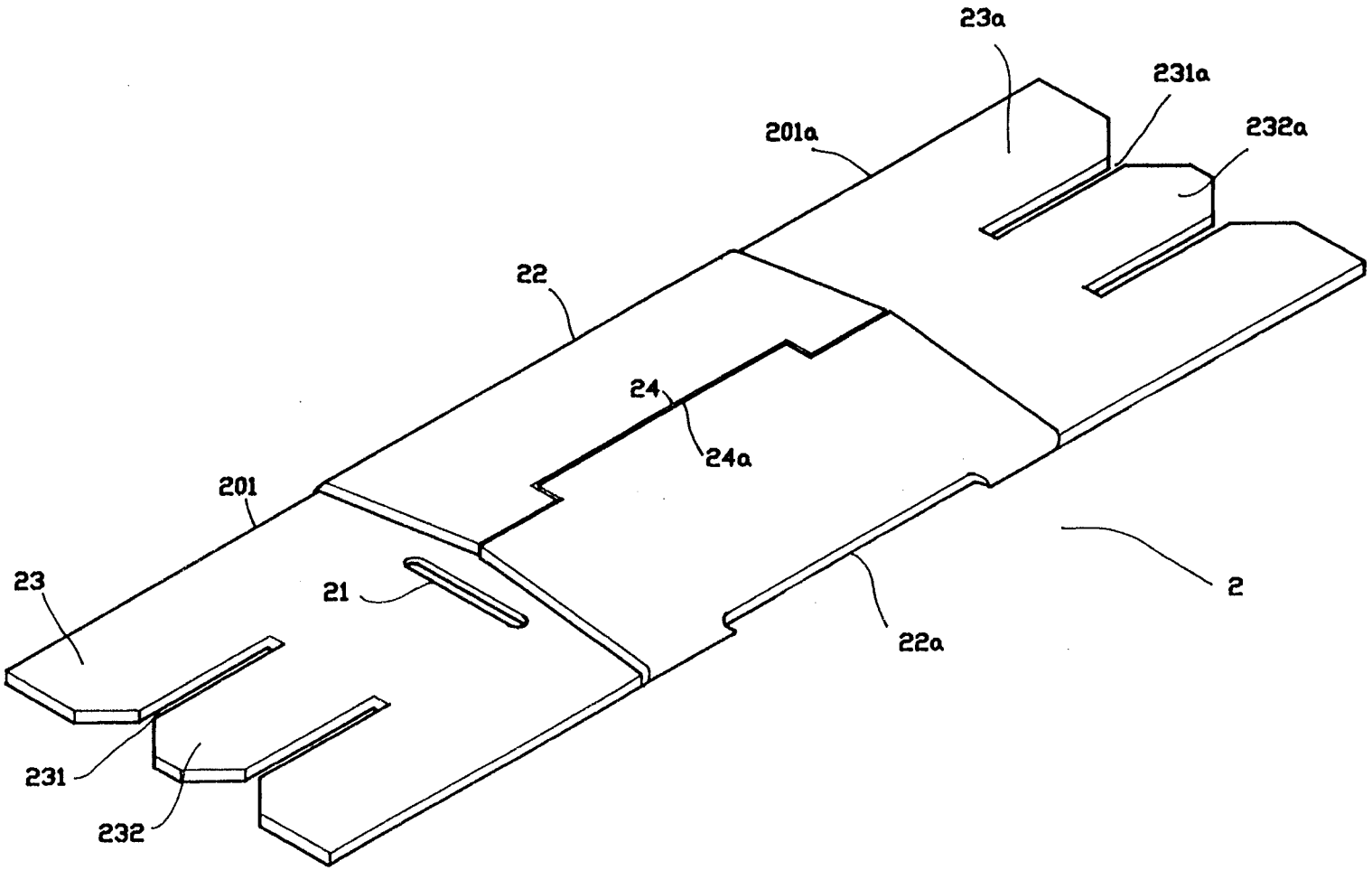
FIG. 6 illustrates the longitudinal flaps of the base folded up and abutted to each other.
Figure 7:
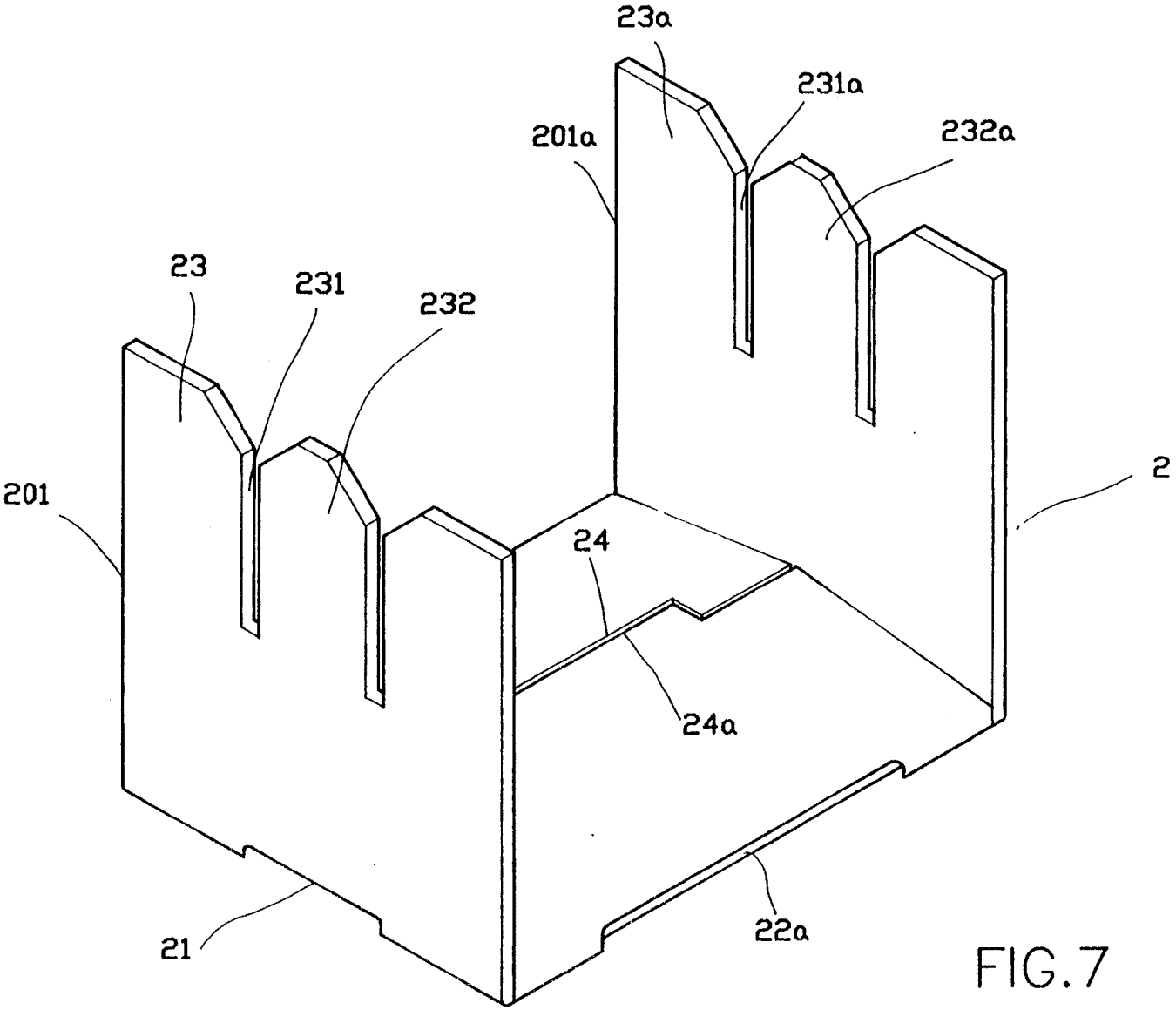
FIG. 7 shows the transverse flaps of the base folded up and disposed on two opposite sides by the abutted longitudinal flaps in a vertical position.

Referring to FIGS. 1, 2, and 3, a shock-absorbing, compression-protective packing device in accordance with the present invention is generally comprised of a base 2, and a product carrier 1 supported on the base 2.

The product carrier 1 is made of a substantially rectangular corrugated board comprising two transverse slots 11;11*a* across two longitudinal intermediate folding lines 1*b*, two longitudinal slots 12;12*a* spaced within the transverse slots 11;11*a* and respectively disposed along the longitudinal intermediate folding lines 1*b* on an outer side, a middle portion B defined within the longitudinal intermediate folding lines 1*b*, a first side portion A and a second side portion C disposed on two opposite sides by the longitudinal intermediate folding lines 1*b*, two fastening strips 13;13*a* extended outward from two diagonal corners thereof in reversed directions, two projecting flaps 14;14*a* extended outward from the other two diagonal corners thereof in reversed direction, two opposite lateral folding lines 1*a* respectively disposed between the side portions A;C and the fastening strips 13;13*a* and projecting flaps 14;14*a*, series of U-notches 141;141*a* respectively made on the projecting flaps 14;14*a* and symmetrically disposed along two opposite sides thereof, and transverse folding lines 1*c* respectively made on the projecting flaps 14;14*a*.

The base 2 is made of a corrugated board comprising two transverse slots 22;22*a* and two longitudinal slots 21;21*a* respectively spaced along the four sides of a rectangle, two transverse folding lines 2*a* respectively passing through the length of the transverse slots 22;22*a*, two longitudinal folding lines 2*b* respectively passing through the length of the longitudinal slots 21;21*a*, two transverse flaps 23;23*a* and two longitudinal flaps 24;24*a* respectively extended outwards from the four sides of the rectangle defined within the slots 21;21*a*;22;22*a*. Each transverse flap 23 or 23*a* comprises two transverse cuts 231 or 231*a* and a projecting strip 232 or 232*a* within the cuts 231 or 231*a*.

Referring to FIGS. 4, 5, 6, and 7, the fastening strips 13;13*a* and projecting flaps 14;14*a* are respectively folded up along the longitudinal lateral folding lines 1*a*, then the projecting flaps 14;14*a* are respectively folded up along the transverse folding lines 1*c* and formed into a corrugated configuration, and then the first and second side portions A;C are respectively folded up along the longitudinal intermediate folding lines 1*b*; the longitudinal flaps 24;24*a* and the transverse flaps 23;23*a* are respectively folded up along the transverse folding lines 2*a* and the longitudinal folding lines 2*b*, permitting the longitudinal flaps 24;24*a* to be collapsed into a horizontal position and abutted to each other and the transverse flaps 23;23*a* disposed in a vertical position at two opposite sides by the collapsed longitudinal flaps 24;24*a*.

Figure 8:
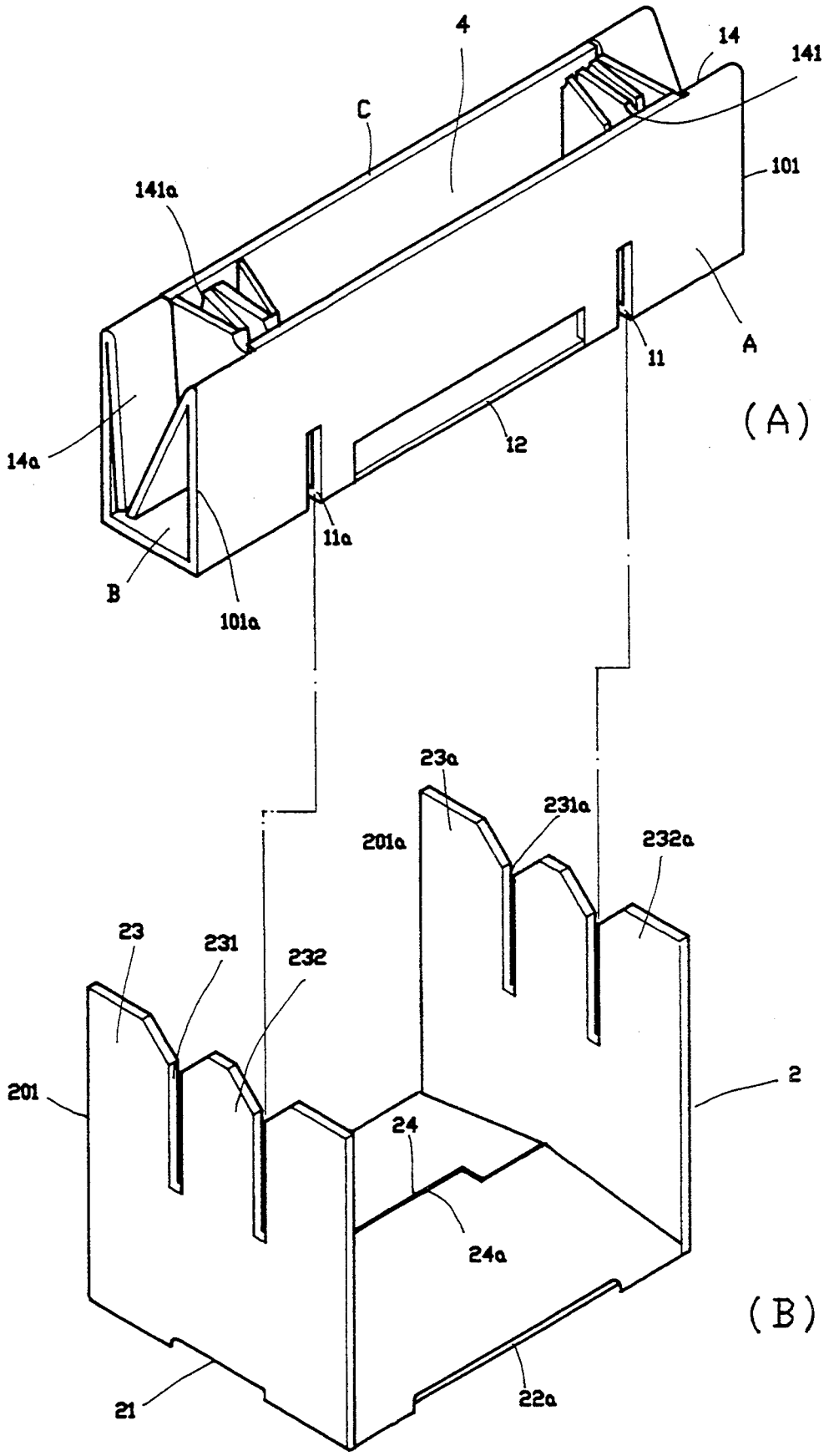
FIG. 8 shows the relative positions between the product carrier and the base.

Referring to FIG. 8, the projecting strips 232 of the base 2 are respectively inserted into the transverse slots 11;11*a* of the product carrier 1, and therefore an open storage chamber 4 is defined within the middle portion B and first and second side portions A;C of the product carrier 1 and the projecting strips 232;232*a* of the base 2 and supported above the longitudinal flaps 24;24*a* of the base 2 for keeping a storage item or storage items.

Figure 9:
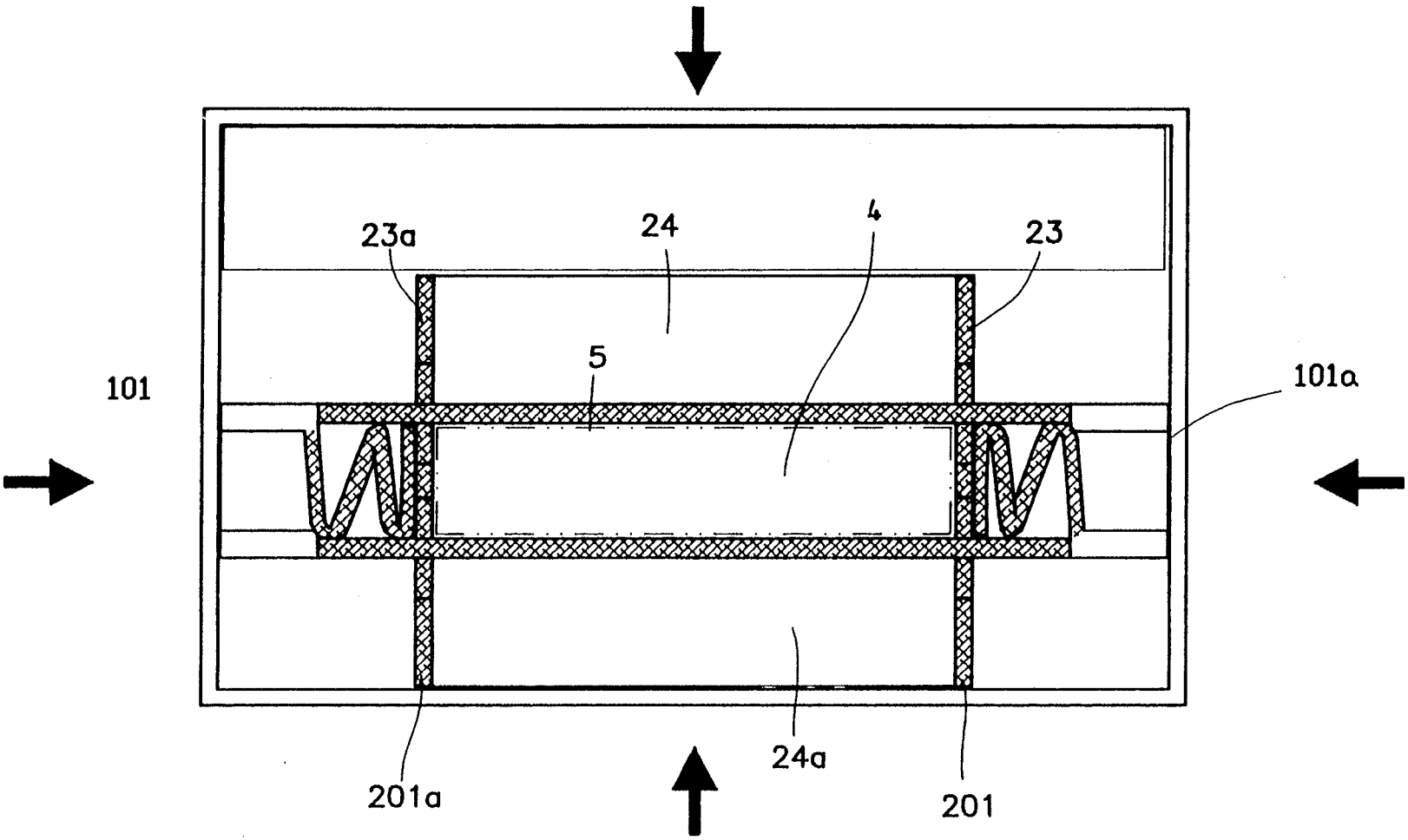
FIG. 9 is a top view in plain of the shock-absorbing, compression-protective packing device.
Figure 10:
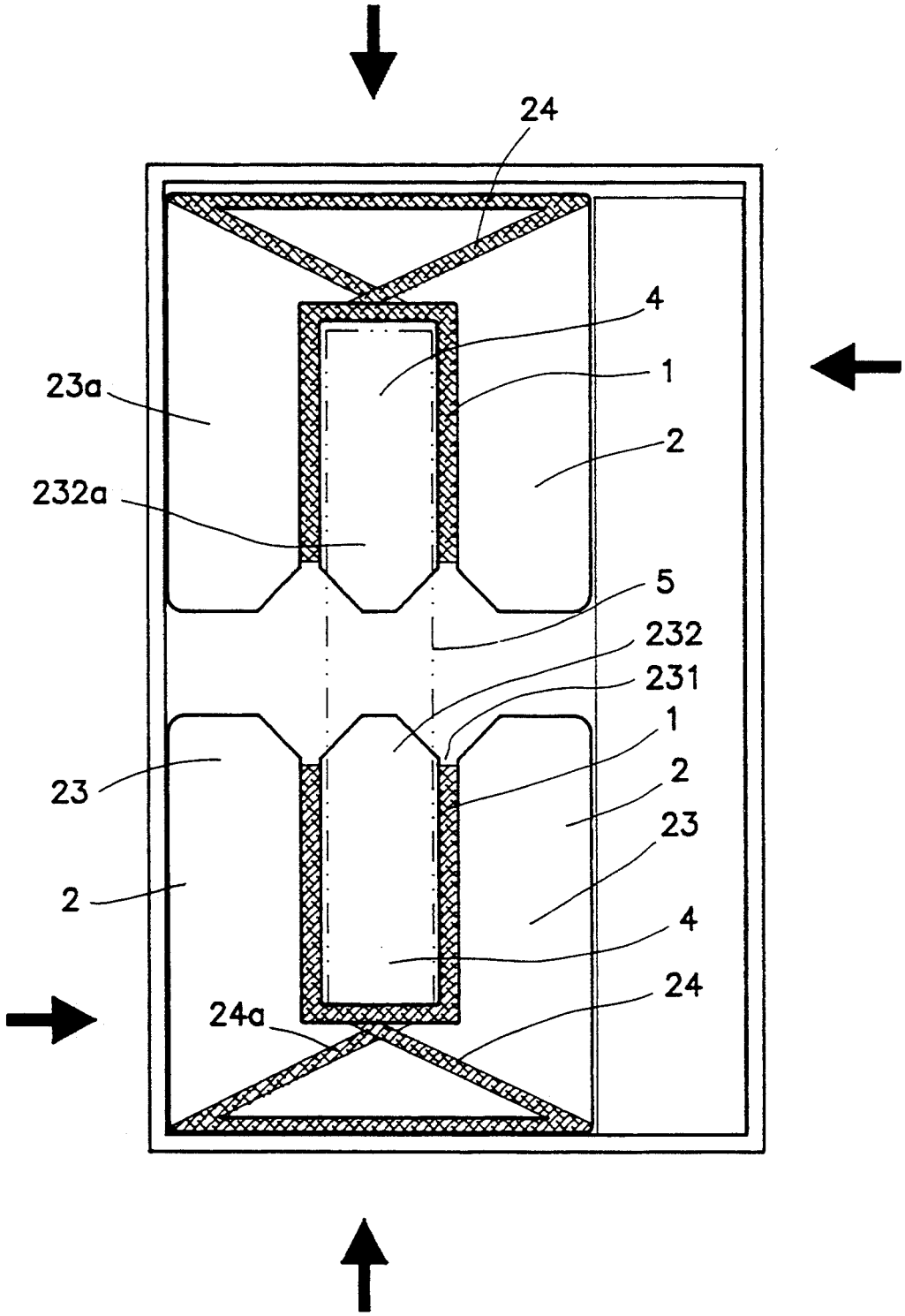
FIG. 10 is a side view in plain of the shock-absorbing, compression-protective packing device.

Referring to FIGS. 9 and 10, the edges 101;101*a* on the product carrier 1 and the transverse flaps 23;23*a* of the base 2 protect the storage chamber 4 against impact from the four sides.

Figure 11:
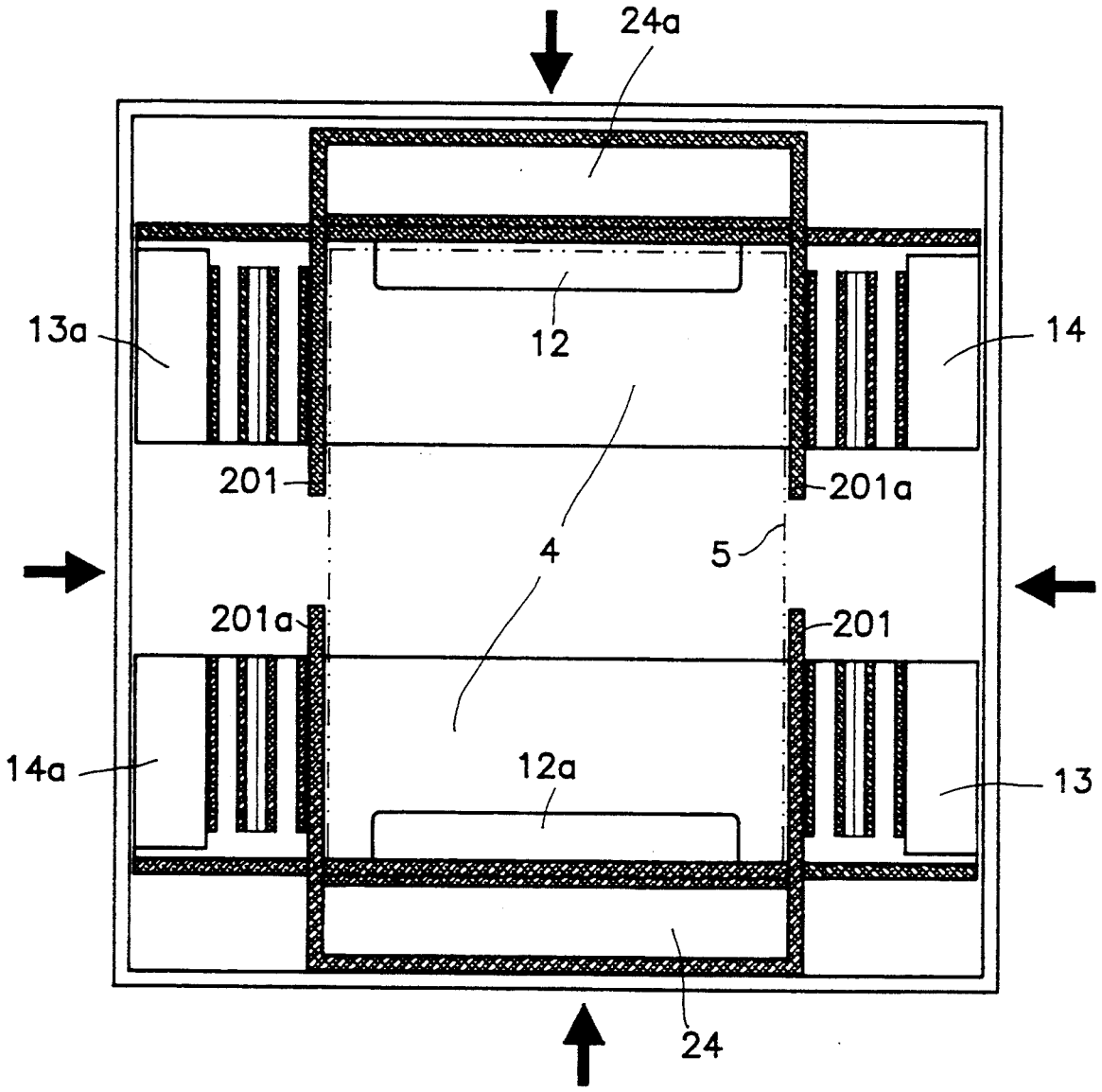
FIG. 11 is another side view in plain of the shock-absorbing, compression-protective packing device taken from another side.

Referring to FIGS. 11 and 10 again, the longitudinal flaps 24;24*a* protect the storage chamber 4 against vertical compression.

Figure 12:
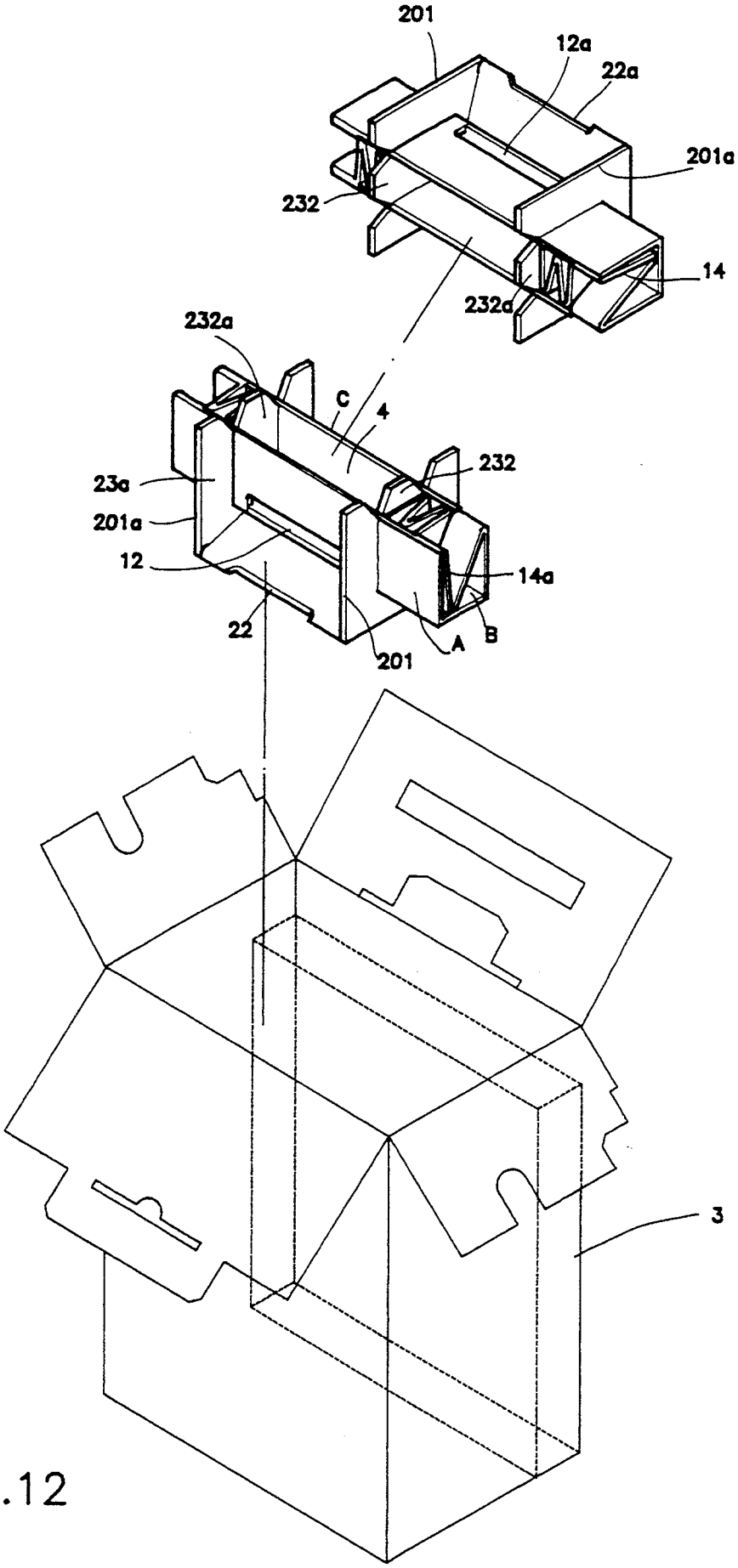
FIG. 12 is a perspective exploded view showing the relative position between the shock-absorbing, compression-protective packing device and a carton.

Referring to FIG. 12, the shock absorbing packing device is fastened inside a carton 3, and the product 5 to be packed is received within the storage chamber 4 of the shock absorbing packing device. Therefore, the product 5 is well protected inside the carton 3 by the shock absorbing packing device against shock waves.

What is claimed is:

1. A shock-absorbing compression-protective packing device fastened inside a carton to keep a product against shock waves, comprising:

a product carrier made of a substantially rectangular first corrugated board comprising two transverse slots (11; 11*a*) across two longitudinal intermediate folding lines (1*b*), two longitudinal slots (12, 12*a*) spaced between the transverse slots (11, 11*a*) and respectively disposed along the longitudinal intermediate folding lines (1*b*) on an outer side of the first board, a middle portion (B) defined between the longitudinal intermediate folding lines (1*b*), a first side portion (A) and a second side portion (C) disposed on two opposite edges of the middle portion (B) on the longitudinal intermediate folding lines (1*b*), two fastening strips (13; 13*a*) extended outward from two diagonal corners of the first board in reversed directions, two projecting flaps (14; 14*a*) extended outward from the other two diagonal corners of the first board in reversed direction, two opposite longitudinal laterally located folding lines (1*a*) respectively each disposed between the side portions (A; C) and the fastening strips (13; 13*a*) and projecting flaps (14; 14*a*), a series of U-notches (141; 141*a*) respectively made on the projecting flaps (14; 14*a*) and symmetrically disposed along two opposite sides thereof, and transverse folding lines (1*c*) respectively made on the projecting flaps (14; 14*a*), the fastening strips (13; 13*a*) and projecting flaps (14, 14*a*) being respectively folded up along the longitudinal laterally located folding lines (1*a*), then the projecting flaps (14; 14*a*) being respectively folded up along the transverse folding lines (1*c*) and formed into a corrugated configuration, and then the first and second side portions (A;C) being respectively folded up along the longitudinal intermediate folding lines (1*b*); and a base made of a second corrugated board comprising two transverse slots (22; 22*a*) and two longitudinal slots (21; 21*a*) respectively spaced along the four sides of a rectangle, two transverse folding lines (2*a*) respectively passing through the length of the transverse slots (22; 22*a*) two longitudinal folding lines (2*b*) respectively passing through the length of the longitudinal slots (21; 21*a*), two transverse flaps (23; 23*a*) and two longitudinal flaps (24; 24*a*) respectively extended outwards from the four sides of the rectangle defined between the slots (21; 21*a*; 22; 22*a*), each transverse flap (23 or 23*a*) comprising two transverse cuts (231 and or 231*a*) and a projecting strip (232 or 232*a*) between the cuts (231 or 231*a*), the longitudinal flaps (24; 24*a*) and the transverse flaps (23; 23*a*) being respectively folded up along the transverse folding lines (2*a*) and the longitudinal folding lines (2*b*), permitting the longitudinal flaps (24; 24*a*) to be collapsed into a horizontal position and abutted to each other and the transverse flaps (23; 23*a*) disposed in a vertical position at two opposite sides by the collapsed longitudinal flaps (24; 24*a*), the longitudinal flaps (24; 24*a*) and the transverse flaps (23; 23*a*) being respectively folded up along the transverse folding lines (2*a*) and the longitudinal folding lines (2*b*), permitting the longitudinal flaps (24; 24*a*) to be collapsed into a horizontal position and abutted to each other and the transverse flaps (23; 23*a*) disposed in a vertical position at two opposite sides by the collapsed longitudinal flaps (24; 24*a*).

whereby the projecting strips (232) of the base are respectively inserted into the transverse slots (11; 11*a*) of the product carrier so that an open storage chamber (4) is defined within the middle portion (B) and first and second side portions (A;C) of the product carrier and the projecting strips (232; 232*a*) of the base for keeping storage items.

2. The shock-absorbing compression-protective packing device of claim 1 wherein said storage chamber is supported above the longitudinal flaps (24;24*a*) of the base for keeping storage items.

* * * * *